US005228269A

United States Patent [19]

Sanfilippo et al.

[11] Patent Number: 5,228,269

[45] Date of Patent: Jul. 20, 1993

[54] APPARATUS AND METHOD FOR REMOVING OXYGEN FROM FOOD CONTAINERS

[76] Inventors: John E. Sanfilippo, P.O. Box 952, Barrington, Ill. 60011; James J. Sanfilippo, 505 N. Lake Shore Dr., #6806, Chicago, Ill. 60611

[21] Appl. No.: 902,316

[22] Filed: Jun. 22, 1992

[51] Int. Cl.[5] ..... B65B 31/06

[52] U.S. Cl. ..... 53/432; 53/510; 53/88; 53/403; 141/155

[58] Field of Search ..... 53/432, 408, 405, 403, 53/510, 88, 79, 101, 474, 473, 273, 272, 271, 284.5; 141/155, 374

[56] References Cited

U.S. PATENT DOCUMENTS

| | | | |
|---|---|---|---|
| 1,216,036 | 2/1917 | Winkley | 141/155 X |
| 1,406,380 | 2/1922 | Heath et al. | 226/20 |
| 2,412,167 | 12/1946 | Minaker | 226/82 |
| 2,760,704 | 8/1956 | Fechheimer | 141/155 |
| 2,768,487 | 10/1956 | Day et al. | 53/11 |
| 2,795,090 | 6/1957 | Sterna | 51/215 |
| 2,855,006 | 10/1958 | Geisler | 141/7 |
| 3,135,303 | 6/1964 | Gordon et al. | 141/66 |
| 3,191,640 | 6/1965 | Hackett | 14/63 |
| 3,250,213 | 5/1966 | Brigham et al. | 101/40 |
| 3,508,373 | 4/1970 | Robinson, Jr. | 53/12 |
| 3,619,975 | 11/1971 | Johnson et al. | 53/112 B |
| 3,670,786 | 6/1972 | Levin et al. | 141/92 |
| 3,760,787 | 6/1972 | Hansen | 141/280 |
| 3,939,287 | 2/1976 | Orwig et al. | 426/316 |
| 3,942,301 | 3/1976 | Domke | 53/510 X |
| 4,014,158 | 3/1977 | Rausing | 53/167 |
| 4,027,450 | 6/1977 | Chiu et al. | 53/112 B |
| 4,055,931 | 11/1977 | Myers | 53/22 B |
| 4,148,933 | 4/1979 | Janovtchik | 53/432 X |
| 4,201,251 | 5/1980 | Bennett et al. | 141/155 X |
| 4,583,346 | 4/1986 | Kameda | 53/431 |
| 4,658,566 | 4/1987 | Sanfilippo | 53/432 |
| 4,703,609 | 11/1987 | Yoshida et al. | 53/431 |
| 4,791,775 | 12/1988 | Raque et al. | 53/510 |

OTHER PUBLICATIONS

Brochure: Jescorp, Gas Flushing Systems, Belt-Vac Series, Jescorp, Inc., 1992.

*Primary Examiner*—James F. Coan

*Attorney, Agent, or Firm*—Willian Brinks Olds Hofer Gilson & Lione

[57] ABSTRACT

An apparatus and method for exposing the interior of containers to controlled environments is provided. In particular, one or more controlled force biased probes are provided for penetrating the contents of a container to inject alternate environments, such as inert gas, to desired locations within the container. The controlled force bias allows the probe to yield should an obstruction be encountered without damaging the obstruction or the apparatus itself. In a particular embodiment, two or more biased probes are provided spaced apart by a distance at least equal to the maximum linear dimension of any anticipated obstruction, so that at least one probe will avoid the obstruction and reach its desired location within the container for processing.

34 Claims, 3 Drawing Sheets

APPARATUS AND METHOD FOR REMOVING OXYGEN FROM FOOD CONTAINERS

TECHNICAL FIELD

This invention relates to an apparatus and method for exposing the interior of containers to controlled environments, such as removing one environment from a container or sequence of containers and replacing it with a new selected environment. More particularly, probes having interior plenums are provided through an opening in the container to conduct a selected environment to desired locations within the interior volume of the container, wherein the probes are biased in a manner to avoid damage should a probe encounter an obstruction within the container. In a preferred embodiment, two or more biased probes are provided such that at least one probe will reach the desired location within the interior volume regardless of the presence of an obstruction, in a manner particularly suited for removing oxygen from the interior of containers of powdered material such as infant formula having measuring scoops (obstructions) within the containers.

BACKGROUND OF THE INVENTION

In certain industries it is necessary to remove as much of an original environment from contact with a product packaged in a container as possible, and to replace it with a new environment. This is particularly critical in the food industry since many foods are susceptible to attack and spoilage from oxygen, and can be preserved much longer in substantially oxygen-free environments. Various techniques are known for removing or minimizing the oxygen content in packaged materials, including use of vacuum in various manners to reduce the residual oxygen content, use of alternate environments such as inert gases to displace or expel undesired oxygen, and combinations of these techniques. For example, U.S. Pat. No. 4,658,566 discloses a uniquely advantageous apparatus for subjecting a continuous sequence of containers to a controlled environment such as a vacuum, and U.S. Pat. Nos. 5,001,878 and 4,905,454 disclose respectively apparatus and methods for exposing the interior of containers to multiple environments such as vacuum and inert gas.

Although such techniques provide excellent results in most circumstances, there are certain materials which present unique difficulties in oxygen-free packaging. For example, finely powdered materials may trap gases within the packed material such that normal techniques for applying e.g. vacuum and inert gas through a top opening of the container may not expel all of the desired oxygen near the bottom of the container. Various techniques have been suggested for overcoming this problem. For example, U.S. Pat. No. 1,406,380 discloses a process for packaging powdered milk in a sterile atmosphere by means of a plunger which is inserted through an opening in the container and forced through the powder to extend substantially to the bottom of the container. A vacuum is then applied to the upper region of the container through a first channel in the plunger, while carbon dioxide or other suitable gas passes through a second channel in the plunger to exit near the bottom of the container, forcing the majority of air out of the container. In U.S. Pat. No. 3,670,786 a reciprocating needle is lowered into an empty vile to inject inert gas into the vile, expelling oxygen-containing atmosphere from the vile prior to filling with e.g. oxygen-sensitive pharmaceuticals. Finally, U.S. Pat. No. 2,149,790 discloses an alternative process for packaging powdered material such as powdered milk, wherein solid needles or the like are pressed into the material and retracted, leaving open spaces in the packed material which permit vacuum or other alternative atmospheres to access a larger exposed volume of the bulk material, and channels for the original atmosphere to exit.

Unfortunately, the known techniques for packaging materials such as powdered milk have several drawbacks. For example, it is desirable today to provide the consumer with a measuring device or scoop within the package. Such scoops are typically inserted into inverted empty or partially filled containers before the majority of the powdered material is added, so that they will reside near the upper surface of the container when opened by the consumer. As previously noted, it is necessary to remove substantially all of the oxygen from the interior of the container prior to sealing the container. Although the U.S. Pat. No. 1,406,380 discloses a plunger which introduces oxygen-displacing gas near the bottom of the container to facilitate removal of the undesired oxygen, use of such a plunger is incompatible with packaging including scoops. For example, if the plunger encounters the scoop, the scoop could be damaged or could interfere with proper operation of the plunger leading to general failure of the process. Specifically, if the plunger is prevented from reaching the bottom of the container, undesired residual oxygen may remain within a portion of the bulk material, contaminating the product.

Accordingly, one object of the present invention is to provide an apparatus and method which will impart a controlled environment to selected regions of the interior of containers, while accommodating the possible presence of obstructions within the container. In particular, it is an object of the present invention to provide such an apparatus and method which will allow successful removal of substantially all oxygen from e.g. powdered infant formula, in a continuous automated process wherein the formula containers may also contain obstructions such as scoops. A related object is to provide such an apparatus and method which minimizes sources of potential contamination, and is economical to construct and operate. A specific object is to provide such an apparatus and method which is adaptable for use with numerous sizes and configurations of containers, and for packaging numerous materials and providing various forms of alternate environments as desired.

These and other objects shall be apparent in light of the present specification.

SUMMARY OF THE INVENTION

In order to achieve the desired substitution of an oxygen-containing or other environment within containers and achieve the aforementioned objects, a biased hollow probe is provided for penetrating the contents of the container from an opening in one end of the container. The desired alternative fluid or gas is conducted by the probe to a selected location within the interior volume of the container, such as proximate the bottom of the container opposite the opening. Force control or biasing means are provided so that the probe will exhibit a controlled maximum force which may be selected to be less than the force required to damage an obstruction within the container, such as a foreign object (e.g. scoop) or the container itself. For purposes of this application and claims it will be understood that a reference to avoiding damage to an obstruction is intended to include therein damage to the foreign object or to the container itself, including damage to the container caused by a foreign object or packaged material which is in turn contacted by a probe.

In a particular embodiment, the present invention further contemplates two or more biased probes. Preferably, at least two of the probes may be spaced apart by a dimension greater than the maximum dimension of any anticipated obstruction so that at least one probe will penetrate to an unobstructed lower portion of the container, regardless of whether another such probe encounters an obstruction.

In a preferred embodiment the force control or biasing is accomplished by means of a pneumatic cylinder, wherein the force imparted by the probe is controlled by the pressure of the operating gas or fluid. The operating gas or fluid may itself comprise an inert gas or fluid, so that any leakage between the operating portions of the cylinder and the interior of the container will not introduce undesired contaminants. In a particular embodiment the desired alternative environment (such as inert gas) for injection into the container may be conducted by means of a channel through the reciprocating tube of a standard gas cylinder. A manifold may be provided to accommodate the upper portion of the reciprocating tube, such that the tube plenum is in communication with the manifold and thereby receives the desired alternative environment.

In each of these embodiments, other sources of environment may be provided, such as sources of vacuum at or near the opening of the container, or other sources of inert gas in other locations.

To retain the material within the container during periods of application of alternate environments (such as vacuum or pressurized gas), a head and appropriate gasket may be provided to seal the top opening of the container through which the probe(s) are introduced. In the preferred embodiment the probe(s) pass through the head and can move relative to the head in a reciprocal manner to allow the desired biasing as described. In a preferred embodiment the probes are retracted to allow insertion and removal of the container without requiring reciprocation of the head itself, and the probes may, in a particularly preferred embodiment, retract into the head such that the ends of the probes are raised to a level at or above the lower edge of the head and gasket so that no obstructions are presented to the container during container insertion and removal.

DETAILED DESCRIPTION OF PREFERRED EMBODIMENTS

Figure 1:
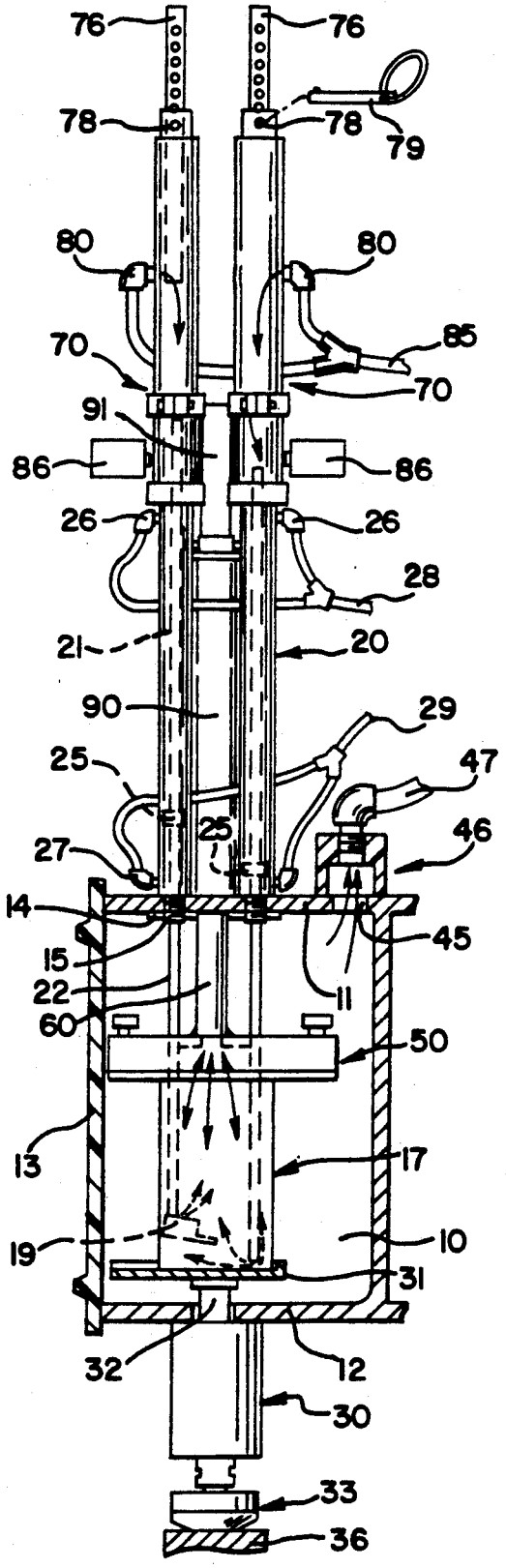
FIG. 1 is a partially cut-away side view of a preferred embodiment illustrating in phantom certain operational features of the present invention.

The remaining portion of the specification will describe preferred embodiments of the invention in conjunction with the attached drawings, in which like reference characters refer to identical apparatus. Specific preferred apparatus which may be employed in practicing the inventive methods are described.

Figure 2:
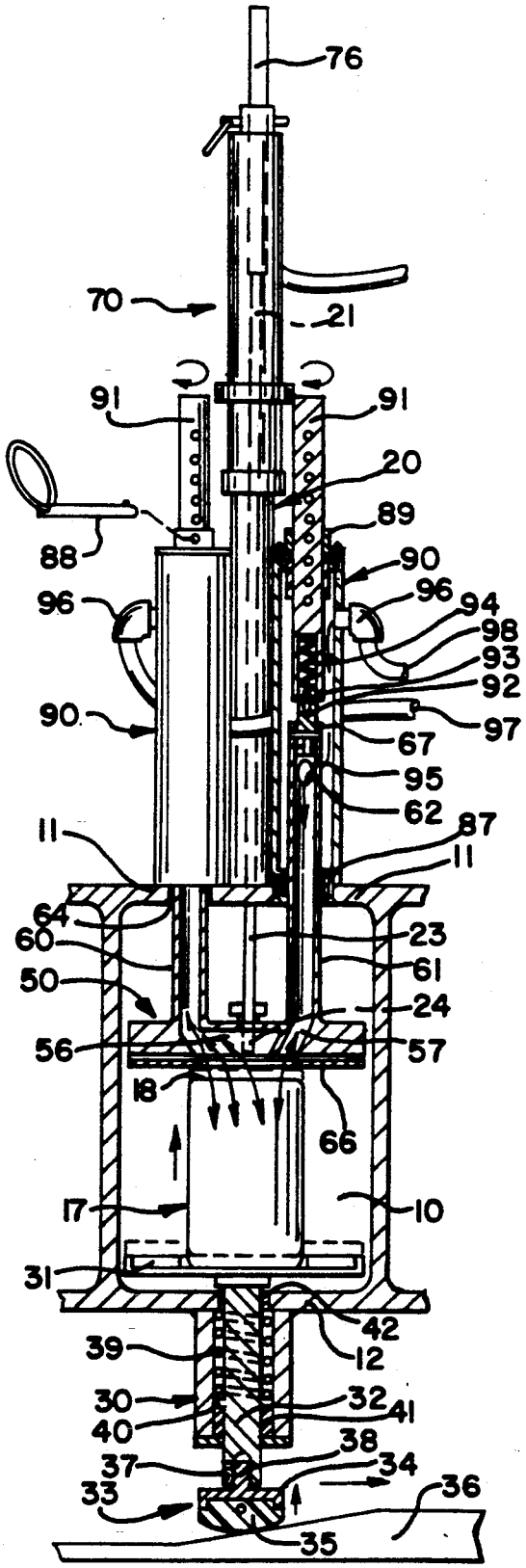
FIG. 2 is a partially cut-away front view of a preferred embodiment, including a cross sectional view of the head assembly and a head manifold.

Preferred embodiments of the inventive apparatus and method are best appreciated from FIGS. 1 and 2. In general, a representative container 17 is shown which may optionally contain one or more obstructions, such as scoop 19. Contents of the container are essentially unlimited, although the present invention is uniquely beneficial in processing finely powdered materials, such as infant formula or other nutritional powders.

The filled container 17 with an open end 18 (or similar opening) is, in the preferred embodiment illustrated, inserted into a sealable chamber 10. The chamber 10 may be an individual chamber of a rotary drum apparatus of the type illustrated in e.g. U.S. Pat. Nos. 4,658,566 and 5,001,878, wherein the chamber is closed during processing by outer enclosure 18 which may comprise a flexible belt. It should be understood, however, that chambers having other configurations may similarly be utilized, including known bell jar and non-rotary devices. Although use of a chamber 10 is preferred, the present invention is not limited to processing apparatus including outer chambers. For example, where the pressure differential during processing will not exceed the physical limitations of a chosen container, such as where robust containers are utilized or where high pressure gas or low pressure vacuum are avoided, it is not necessary to the present invention to provide an outer chamber 10.

Essential to the present invention are one or more probes 23 having an interior plenum or channel for conveying alternate environments as described herein. The probes and the container 17 are movable relatively toward and away from each other, such that the probe may pass through the opening 18 into the contents of the container to a desired location and a selected environment may be delivered into the container at the desired location. A probe may be provided with specialized tips, such as tapered or pointed ends, to facilitate penetration of the container contents or to assist in delivering the selected environment. However, for processing finely powdered infant formula it has been found that a cylindrical stainless steel tube having an outer diameter of approximately 5/16 inches and an inner diameter of approximately 3/16 inches with a cylindrical, non-tapered terminus is desirable.

Means are provided for reciprocating the probes 23 relative to the container 17 while maintaining a desired bias on the probe so that it may yield if it encounters a foreign object or obstruction or if excessive force is otherwise applied. In the preferred embodiment illustrated the reciprocation and biasing functions are both provided by a fluid cylinder, such as pneumatic cylinder 20. Cylinder 20 is of standard design, and may preferably comprise a 1 1/16 inch bore by 11 inch stroke hollow rod air cylinder. Part no. 09-11-DXDEH by BIMBA is one preferred cylinder.

The cylinder assembly includes an inner reciprocating tube which has, in the vertical orientation illustrated, an upper section 21 and a contiguous lower section 22, preferably comprising a stainless steel tube. A washer-shaped piston 25 is secured to the midpoint of the reciprocating tube and engages the inner surface of the cylinder 20 in a substantially fluid-tight seal. The reciprocating tube exits the cylinder 20 at each end through appropriate seals (not illustrated), and the cylinder is provided with means for attaching the cylinder at either end, such as threaded collars 15, 16.

Ports are provided in the cylinder at each end for supplying drive fluids such as pressurized gas. In the vertical orientation illustrated, a port 27 is provided for up-drive fluid, and a port 26 for down-drive fluid.

When the down-drive fluid pressure exceeds the up-drive fluid pressure by a sufficient amount, a downward force will be imparted to the piston 25 and thus the reciprocating tube. The magnitude of this force is determined by both the pressure differential between the drive fluids and the size of piston 25. This force should be sufficient to overcome the combined frictional and other resistive forces on the probe to move the probe at sufficient penetration speed to accommodate the desired processing rate, but less than the force required to permanently damage any obstruction (e.g. foreign object or the container itself). The frictional and other resistive forces include (without limitation) the friction of the cylinder itself (including the piston and end seals), the friction of any head seals, and the force required to penetrate the packaged material. Differences in these forces may require different drive forces for specific operation, and may be determined by one of ordinary skill in this art without undue experimentation. For example, during setup the down-drive fluid pressure may be gradually increased until suitable penetration and reciprocation speed is achieved for the particular material being processed. It has been found that the piston of the aforedescribed cylinder assembly reciprocated in a downward direction by a pressure differential of approximately 0.5–5 $lb/in^2$, and preferably 1–2 $lb/in^2$, provides a desirable controlled non-excessive force as described herein depending on the factors discussed above.

Similarly, when the pressure of the up-drive fluid exceeds that of the down-drive fluid by a sufficient amount, the resulting differential force on piston 25 will be transmitted to the reciprocating tube and cause the tube to move in an upward direction, subject to frictional and other forces encountered by the tube. Greater up force may generally be applied since there is generally no danger of damaging the container or any obstruction when the probe is retracted.

It will be understood that appropriate seals should be provided at the intersection of the movable elements described to maintain the desired gas-tight construction. For example, the gas cylinders 20 typically incorporate a seal between the cylinder enclosure and the reciprocating tube. However, to prevent inadvertent contamination by cylinder operating fluids, it is desirable to utilize pressurized nitrogen or other inert gasses as the operating fluid for the gas cylinders. In this way, should there be any undesired leakage into the probe supply plenum 70 or the chamber 10, no contamination will result.

In the preferred embodiment the lower reciprocating tube portion 22 may itself comprise the probe 23. However, it should be understood that the reciprocating element of the cylinder 20 may instead be used as a drive mechanism for alternative probes, or other means of providing the desired reciprocating motion may be employed without departing from the scope of the present invention.

If the tip of a probe as described encounters an obstruction 19, the obstruction will impart an upward force to the probe 23. By selecting appropriate down-drive pressures as described, the maximum force exerted by the probe can be controlled to be less than the force required to damage the obstruction (such as a scoop or the container itself including scored or other "easy open" end configurations). If no obstruction is encountered, however, a probe will preferably penetrate the contents of the container 17 until the probe tip 24 is at a desired location, preferably proximate to the bottom of the container. It has been found that spacings of approximately ⅛ to ¼ inch from the container floor are preferable, although other locations within the interior of the container can be selected as desired.

In the preferred embodiment illustrated two probes 23 are provided, each having separate biasing and reciprocating means. In this manner it is possible for the two probes to assume different locations as illustrated in FIG. 1. Thus, if one probe encounters an obstruction causing its biasing means to yield and the tip of the probe to cease penetration of the container contents before reaching its desired location, another such probe may continue its penetration to its desired location. Where a solid object or other obstruction 19 is contemplated within the container 17, at least two probes 23 are preferably provided and spaced apart by a distance which is at least equal to the maximum linear dimension (in any orientation) of the obstruction. In this manner it is assured that at least one probe will not engage the obstruction and will therefore reach its desired location within the container.

The cylinders 20 may be mounted through the top wall 11 of chamber 10 and secured by any suitable means, such as mounting nuts 14.

Other means of providing a controlled force or probe bias may alternatively be employed. By way of example only, biased tips may be provided on the penetrating ends of the reciprocating probes, or known feedback techniques may be used to monitor penetration of the probe and control the motive means driving the probe. For example, should appropriate sensors indicate that the probe tip is experiencing excessive resistance indicating an obstruction (i.e. by means of a strain gauge), or that the motive means is requiring a driving force (i.e. electric current or fluid pressure) beyond desired normal levels, or that movement of the probe has ceased before the probe has reached its desired location, movement of the probe may be stopped or otherwise adjusted to control the force exerted on any obstruction. Regardless, it is desirable to provide separate biasing for each probe to allow the independence in positioning required for the preferred operation as described.

Figure 6:
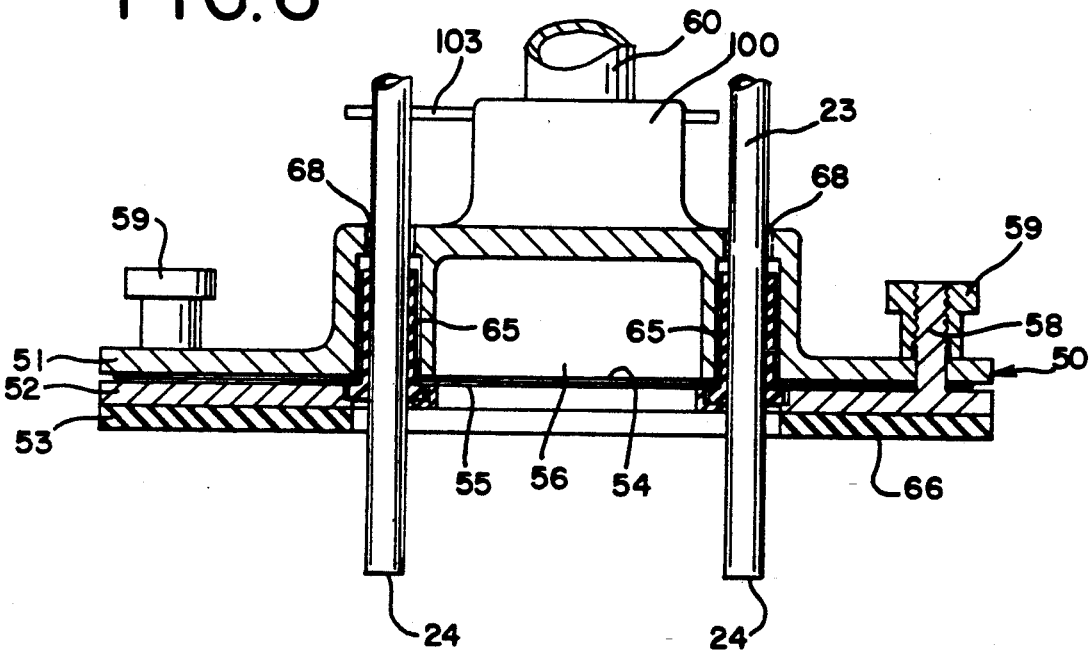
FIG. 6 is a cross-sectional side view of a flushing head assembly for use with a preferred embodiment of the present invention.

The preferred embodiment further includes a head assembly 50 as shown in FIGS. 1 and 2 and detailed in FIG. 6. The head assembly 50 provides guiding support for the probes 23, and also provides a seal for the opening 18 of container 17 to prevent the container contents from blowing or spilling out of the container during processing. By providing a substantially gas-tight seal to the opening 18, the head assembly isolates the interior of the container from the exterior region, including the interior of chamber 10. Thus independent environments may be supplied inside and outside of the container. Oxygen-containing environments can therefore be utilized within the chamber 10 to control chamber pressure outside of the container, without contaminating the contents of the container.

To assure such isolation, seals 65 may be provided in probe apertures 68 of the body 51 of the head assembly to provide a substantially gas-tight seal with the biased probes. The seals are preferably soft polyurethane and assist in accommodating variances in alignment and permitting a limited degree of lateral motion. A head gasket 53 may be provided on the lower surface of the head assembly 52 for contacting the opening 18 of container 17 to provide a substantially gas-tight seal to the container. The gasket may preferably comprise a soft polyurethane or similar material of sufficient thickness to accommodate anticipated variances in container height while still providing the desired seal.

Alternate environments may be introduced to the upper region of the container 17 through plenums in the head assembly 50. In particular, a first plenum 56 in the body 51 is shown in communication with a supporting conduit 60. The plenum 56 is also in communication with the interior of container 17 through opening 18, and sources of vacuum and/or inert gas may therefore be supplied to the interior of the container via conduit 60 and plenum 56. In a preferred mode of operation, for example, nitrogen gas is introduced through the probes to the lower region of the container 17 while vacuum is applied by means of plenum 56 to the upper region of the container.

To prevent the processed material, such as powder, from being entrained and transported out of the container, a filter element 55 is provided. The filter may preferably comprise a stainless steel screen or weave having openings smaller than the particle size of entrained material. Preferably the openings are substantially smaller than the particles to prevent partial penetration by the particles and clogging of the filter media.

By way of example, screens of 400 mesh or finer may be used, although the suitable filter will depend on the granular constituents of the material being processed. For nutritional powders, a filter having 600 mesh or finer is preferred. A particularly preferred filter media for use with nutritional powders is a woven stainless steel media such as Dutch weave woven media sold under the registered trademark Betamesh by Tetko Manufacturing, having openings of approximately 25 microns.

A filter support plate 54 is provided to mechanically support the filter, and in particular to support the filter against the flow of gas into or out of the plenum. The filter support element may comprise a coarse screen or perforated plate.

The filter element 55 and support member 54 are retained by a lower plate 52 cooperating with head body 51. Threaded studs 58 cooperate with knobs 59 to secure the head assembly in an assembled configuration while permitting disassembly for replacement of the filter or other maintenance. Gaskets (not illustrated) may also be provided between any or all of the lower plate 52, filter element 55, support member 54, or main body 51 of the head assembly 50.

The head assembly may further include other plenums in communication with the interior of the container. In a preferred embodiment, for example, a second plenum 57 is provided which is connected to a separate supporting conduit 61 and therefore provides access to the interior of the container 17 independent from plenum 56 and conduit 60. Plenum 57 and conduit 61 may be used, for example, to monitor the pressure inside of the container while the main plenum 56 and conduit 60 are being used to convey vacuum or other alternate environments to the container interior. Plenum 57 may also be used for pressure equalization during back flushing of the filter element 55 through the major plenum 56.

Although a preferred embodiment of the head assembly 50 has been described, it is understood that alternate head designs could similarly be utilized. Further, it is not necessary to provide a sealing head assembly where the material being processed is not susceptible to significant entrainment.

In the preferred embodiment illustrated the head assembly is maintained in a fixed position relative to the chamber 10. To seal the container to the head assembly a lifting plate 31 is provided. The lifting plate 31 elevates the container 17 after insertion into contact with the gasket 53, by means of a lifting rod 32 passing through a substantially gas-tight seal 42 in the lower wall 12 of the chamber. The lifting rod 32 is in turn reciprocated against the force of biasing spring 39 by a thrust delivered from a cam follower 33 engaging an inclined cam race 36. The cam follower may preferably comprise a low friction contact element 35, such as an ultrahigh molecular weight plastic or Teflon material supported by a suitable cap 34. To provide fine height adjustments the cap 34 may have an adjustment screw cooperating with the lifting rod 32 and secured by suitable means, such as split collar 37. Other reciprocating means may alternatively be employed, including electrical or pneumatic actuators, and the relative movement between the head and the container may be accomplished by moving the head, the container, or both the head and container. The reciprocating force engaging the container with the head assembly should be sufficient to accommodate any opposing forces resulting from any pressure differential developed during processing, such as forces developed between the container and the head assembly when pressurized gases are introduced to the interior of the container.

In the preferred embodiment illustrated, the environment supply conduits 60, 61 also provide the necessary mechanical support for head assembly 50. In particular, the conduits may comprise plastic or metallic tubes attached to the main body 51 of the head assembly 50. By providing suitable mechanical support for the ends of these supply conduits, the head may be securely mounted without need of additional mounting hardware. To allow easy removal of the head assembly 50 or conduits 60, 61 for cleaning or maintenance, or for adapting the apparatus for use with differing products or containers, it is desirable to provide a disengageable connection for the head assembly and/or conduits.

Figure 7:
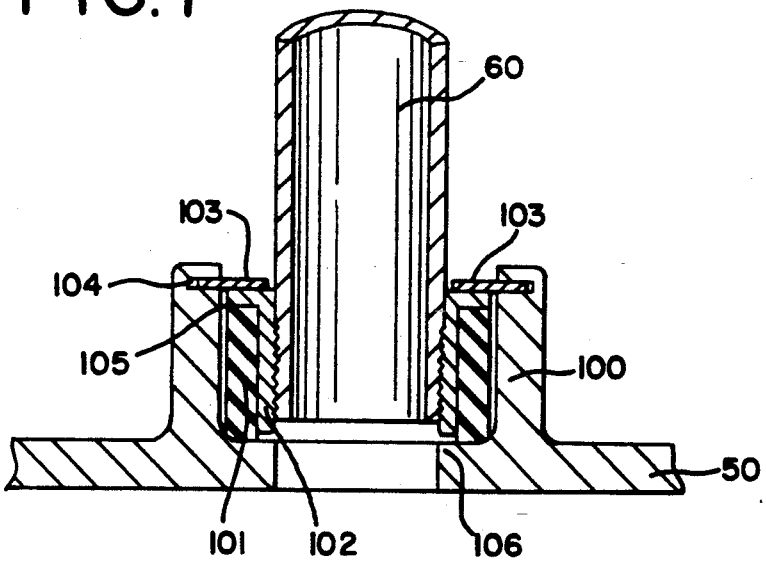
FIG. 7 is a cross-sectional front view of a preferred connection between a head body and a supply conduit.

The tubes may be permanently attached to the head assembly 50 or, in a preferred embodiment, may be detachably secured. For example, as shown in FIG. 7 the supply conduit 60 may be provided with a means for mechanically cooperating with the head assembly 50. A threaded sleeve 102 is shown including a radial collar 105. A cylindrical spring tube 101 is provided, which is preferably dimensioned to be sightly longer than sleeve 102. A cooperating recess for receiving the spring tube 101 is provided with the head assembly 50, such as the recess formed by upstanding sections 100 as illustrated.

Means are provided for detachably retaining the aforedescribed assembly within the head assembly recess. For example, slots 104 may be provided in the upstanding sections 100 to receive a slide clip 103, which may have an elongated "C" configuration to allow the spring clip 103 to be inserted into the slots 104 around the supply conduit 60, trapping the radial collar 105 as illustrated. It will be understood, of course, that alternative techniques for detachably securing may similarly be employed by those having ordinary skill in this art.

In the preferred embodiment illustrated, the spring tube 101 provides multiple functions. The spring tube is preferably made of an elastomeric material, such as polyurethane having a hardness rating of approximately 35–40 durometer. The spring tube 101 will therefore provide a substantially air-tight seal between the conduit 60 and the head assembly 50. In addition, by providing gaps or dimensional relief between the conduit 60, the spring clip 103, and the upstanding section 100 of the head assembly 50, the conduit 60 may have a limited degree of freedom due to the elastomeric properties of the spring tube 101, without affecting the desired gas-tight seal. By allowing for a limited amount of deflection, the detachable connection can accommodate certain machining and manufacturing variances. Similarly, by providing axial clearance between the conduit 60 and the head assembly 50 the elastomeric spring tube 101 may itself provide vertical lost motion biasing for the head assembly 50. However, in the preferred embodiment the container 17 is lifted by lifting plate 31 until spring tube 101 is compressed and the bottom edge of sleeve 102 is in contact with the inner lip 106 of the recess. This mechanical interference allows suitable force to be imparted to the head assembly 50 to maintain a gas-tight seal between the container 17 and gasket 53.

To allow flexible operation it is desirable to provide a system which is adaptable to containers of various sizes. In the embodiment illustrated this may be accomplished by selecting the appropriate elevation for head assembly 50 in the manner to be described below; by adjusting the travel of the probe to correspond with the head assembly position; and by providing an appropriate lifting plate 31 to accommodate the size and shape of the desired container.

A suitable apparatus for providing adjustable support for the supply conduits 60, 61 of the head assembly 50 is illustrated in FIG. 2. In conjunction with a head manifold 90 a height adjustment rod 91 is provided which exits the manifold through an appropriate seal 89. The height adjustment rod may be provided with means to secure its position at various heights, such as periodic apertures cooperating with a quick disconnect pin 88 as illustrated. Other similar means may also be employed.

It is desirable to provide some biased lost motion or yield relative to the lifting plate 31 and the head assembly 50 to accommodate slight differences or imperfections in the height of inserted containers 17. A lost motion bias may be provided at any desired location. In a preferred embodiment, head gasket 53 allows variable penetration to accommodate normal variance in container height.

Also illustrated is a less preferred disengagable connection between the conduits 60, 61 and the adjustment rods 91. Twisted L-slots may be provided in the lower portions of the engagement elements 92, which cooperate with supporting pins in the upper portions of the respective conduits 60, 61. To assemble the resulting apparatus the conduits 60, 61 are passed upwards through aperture 64 in the upper wall 11 of the chamber 10 through suitable seals 87. The adjustment rods 91 and corresponding engagement elements 92 are then lowered into contact with the upper portions of the conduits 60, 61 so that the L-slots engage the respective mounting pins. The adjustment rods 91 or the conduits 60, 61 are then rotated relative to one another through a suitable arc to allow the mounting pins to transverse the horizontal portions of the twisted L-slots, whereby the pins will be supported vertically by engagement elements 92. Quick disconnect pins may then be inserted through the desired apertures and corresponding fixed apertures in the upper portion of manifolds 90, to both secure the height adjustment rods in the desired vertical location and, where rotatable rods are used, to retain the rods in their mounting pin engaging radial position. It should be understood, of course, that other techniques which will be known to the person having ordinary skill in this art may similarly be employed for mounting the head assembly and for providing adjustable support.

Other forms of lost motion biasing are also illustrated in connection with head support structures. In particular, biasing spring 94 is illustrated in conjunction with the adjustment rods 91, although it will be understood that other placements of similar function biasing springs are also possible and will be known to those having ordinary skill in the art. Spring 94 is preferably fully compressed, or compressed sufficiently to permit axial mechanical interference between members of the head support structure, when the container 17 is lifted into sealing engagement with the head assembly 50. In this manner, springs may be utilized which provide less biasing force than required to maintain the head assembly 50 in sealing contact with the container 17 during processing. However, when the container is moved away from the head assembly sufficiently to disengage the mechanical interference, or to permit some extension of the biasing spring 94, the spring 94 will then impart a bias to the head assembly to maintain it in contact with the container 17. In a preferred operation, after processing the interior of the container for removal of oxygen, the container and head assembly are preferably vibrated to settle the contents in the container, and to dislodge any accumulated material from the filter element 55. By maintaining a biased contact between the head and the container during the vibration, contents of the container are prevented from spilling out of the container, and the desired vibration may be transmitted between the container and the head assembly. The lost motion aspect of the biasing arrangement illustrated permits minor translational movement of the head assembly in response to the vibration.

The conduits 60, 61 are provided with one or more apertures 62 communicating with the interior of the conduits to permit selected environments to pass between the interior of the conduits and their exterior. In this manner the interior of the conduits, and thus the plenums 56, 57, are in fluid communication with the interior of head manifolds 90. Ports 96 may then be provided communicating with the interior of the supply manifolds 90 to permit introduction of alternate environments 97, 98 to the manifolds 90, thence the conduits 61, 62, thence the plenums 56, 57, and ultimately the interior of the container 17. It should be understood that the desired environments may instead be conducted to the head assembly by means of flexible tubes or other means.

It is preferable to provide means for adjusting the upward vertical travel of the probes 23 to correspond with the selected elevation of the head assembly 50. In particular, the ends 24 of the probes 23 must, in their raised or retracted position, provide sufficient clearance for the container 17 to be inserted and removed. In a preferred operation, the ends 24 are raised to a level at or above the lower surface 66 of the gasket 53 to provide a smooth, unobstructed region for container insertion and removal. In addition, it is desirable to retain the end 24 within the head assembly 50 (that is, to prevent the ends 24 from retracting fully through the head assembly so that they are no longer in engagement with the assembly) to provide desired mechanical support for the probes 23 and maintain alignment of the probes with the head assembly and seals.

To accomplish this, the preferred embodiment includes adjustable probe stops 76 in conjunction with probe manifold assemblies 70. Similar to the height adjustment rods 91, the adjustable probe stop 76 may be provided with numerous spaced apertures to be selectively engaged in alignment with aperture 78 of the manifold assembly 70 by removable pin 79. In use, the upper portion 21 of the reciprocating tube of the cylinder 20 will, when driven in the upward direction, rise until engaging the probe stop. FIG. 2 illustrates in phantom the upper portion 21 of the reciprocating tube in a full up position, engaging the probe stop 76 with end 24 of the probe 23 residing within the head assembly 50 as desired. Other means, such as control of the motive means driving the probes in response to probe elevation, or mechanical stops at other locations, may alternatively be employed.

Under certain conditions it is possible for gas and entrained contents to pass undesirably through this probe conduit in an upward direction. To minimize the potential for contamination of the apparatus it is desirable to provide a probe filter. Although the filter can be incorporated at any point, and may in particular be provided by a suitable filtering tip at the lower end of the probe 23, in the preferred embodiment illustrated in FIG. 3 the filter element 83 is retained by a removable cap 82 cooperating with a filter support 81 attached to the top of the upper portion 21 of the reciprocating tube. The filter element 83 may comprise a fine mesh screen as used in connection with the head assembly itself, or other suitable filter elements which are known. Any material which might otherwise blow through the probe conduit in an upward direction, such as when pressurized gas is being supplied to the interior of the container 17 through plenums of the head assembly, will be removed at the filter cap before contaminating the probe manifold assembly 70. Further, a suitable gasket 69 may be provided on the lower surface of the probe stop 76 to engage the upper surface of the reciprocating tube or probe filter assembly in its full up position, providing a substantially gas-tight seal closing the probe conduit when the probe is raised and inactive.

Figure 3:
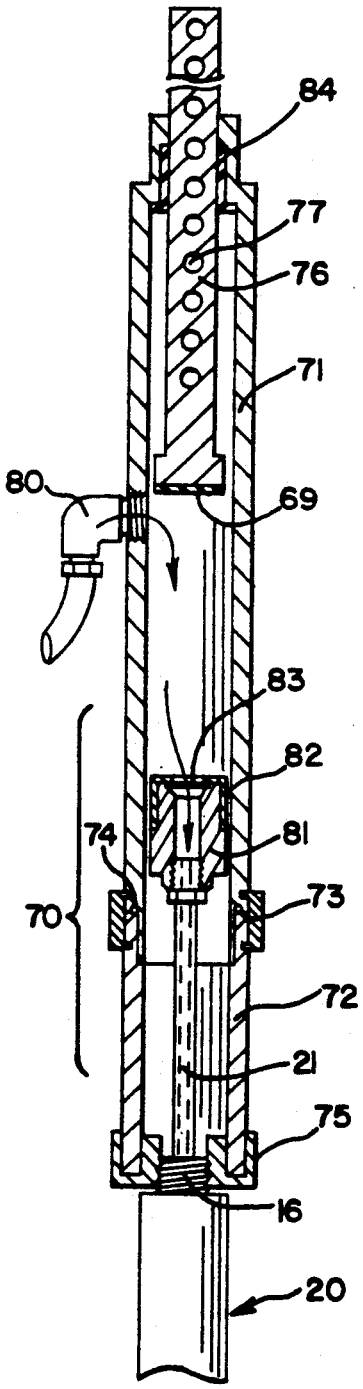
FIG. 3 is a cross-sectional view of a probe manifold assembly.

The selected environments to be injected by the probes are supplied in the preferred embodiment by means of probe manifold assemblies 70 illustrated in FIG. 3. In particular, a port 80 is provided in communication with the interior of the manifold assembly 70, and is in turn connected to a source 85 of the desired probe environment. The environment, typically an inert gas such as pressurized nitrogen, will pass into the interior of the manifold 70, and thence into the plenum of the reciprocating tube and probe 23, and thence to the interior of the container as desired. To permit access to the interior of this manifold for maintenance, such as for cleaning or for replacement of the filter element 83 described above, the manifold assembly may preferably comprise an upper manifold tube and a lower manifold tube joined by a suitable joiner 73. To maintain the desired gas-tight nature of the manifold, a suitable gasket or O-ring 74 may be provided. It should be understood, of course, that numerous techniques may be utilized for joining the manifold segments, or for otherwise providing a manifold for introduction of the desired probe environment. Finally, the manifold assembly 70 may be attached to the upper end of the pneumatic cylinder 20 by means of e.g. a threaded mounting collar 16 cooperating with a threaded manifold end cap 75.

The probe manifold may preferably be made of a transparent material such as Lexan so that the relative positions of the probe assemblies may be determined visually by the operator. In addition, in an automated process it may be desirable to provide sensors 86 to determine elevation of the probes, such as when in the full-up or full-down position. When used to detect the full-up position, the sensors may be provided with adjustable mounting means to adjust their vertical location to correspond to the probe stop positions. Full-down sensors are desirable to assure that at least one probe does in fact descend to the desired location near the bottom of every container, and to identify any containers where neither probe has descended to the desired location so that those containers, which may not be adequately processed, can be discarded or reprocessed as desired.

It should be understood that the desired probe environment may be communicated to the probe by alternative techniques as well. For example, flexible supply tubes may be directly attached to the top of the reciprocating tube of the probe 23 without use of any manifold.

Figure 4:
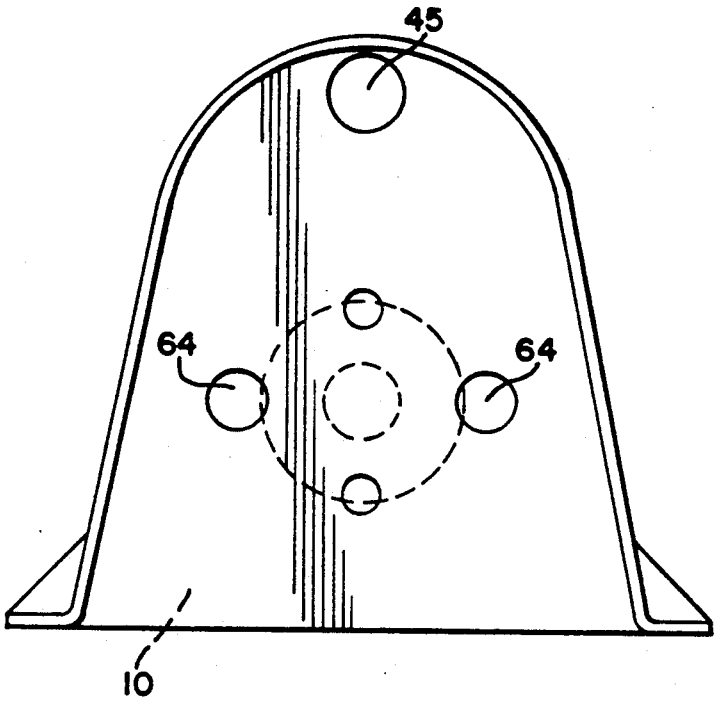
FIG. 4 is a top view of a preferred chamber for optional use with the present invention.
Figure 5:
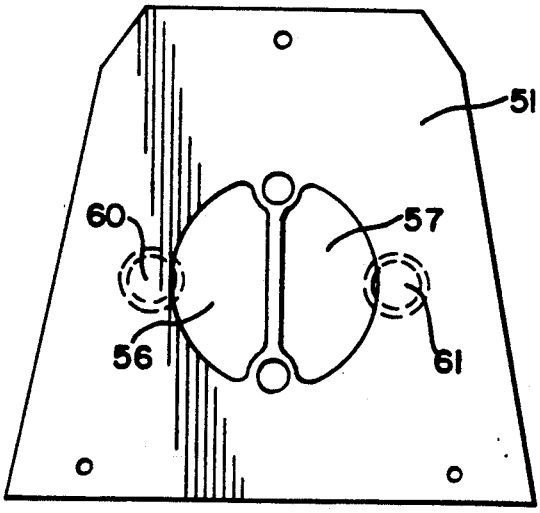
FIG. 5 is a bottom view of a head body for use with a preferred embodiment.

Because of the finely powdered nature of e.g. infant formula it is desirable to minimize locations where incidental powder might accumulate over time in an automated process. In this regard it is desirable to provide the interior of any chamber 10 with rounded joints and surfaces to facilitate cleaning and avoid corners where material could collect. A particularly desirable configuration for such a chamber for use in a rotary apparatus is illustrated in FIG. 4.

Operation of the preferred embodiment illustrated may now be described. The apparatus is first adjusted by the operator to accommodate the desired size and shape of container 17. In particular, the head assemblies 50 of the chambers 10 are adjusted to an appropriate height, and the probe stops 76 are correspondingly adjusted so that the tips 24 of the retracted probes 23 will reside as desired within the head assembly and provide an unobstructed region for insertion of the containers 17. With an appropriately sized and shaped lifting plate 31 in its lowered position, a container having an open upper region is inserted by known techniques. The lifting plate 31 will then elevate the container into sealing contact with the gasket 53 of the head assembly 50, isolating the interior of the container from the exterior region of the chamber 10. Various alternate environments may then be provided to the interior of the container by means of the head assembly, in manners known in the art.

Importantly, the probes 23 may be lowered through the contents of the container to a desired location, such as near the bottom of the container. Desired alternate environments, such as nitrogen gas, may then be introduced through the probes to the lower region of the container, while other environments (such as vacuum) may be applied by means of the head assembly. In this manner substantially all oxygen within the container may be successfully removed. Should a probe encounter an obstruction, such as scoop 19, the probe will be stopped without damage to the scoop, the probe, or the container itself. By providing multiple probes, including at least two probes spaced apart a distance at least equal to the maximum linear dimension of any anticipated obstruction, it may be assured that at least one probe will not encounter the obstruction and will descend to the desired location near the bottom of the container to introduce the atmosphere as required. Sensors 86 may confirm that at least one probe has successfully reached the desired position.

During processing the environment exterior to the container may likewise be controlled. For example, the chamber 10 may be sealed by enclosure 13 and vacuum or other alternate environment supplied such as by means of supply 47 in communication with the interior of chamber 10 by means of sliding seal 46 and chamber aperture 45. By proper manipulation of the chamber pressure, the pressure differential across the container walls can be maintained within chosen limits. This has the dual advantages of minimizing stress on the container (including the container walls and seams, and any "easy open" ends) and minimizing the pressure differential at the point of contact between the container opening 18 and the head assembly gasket 53. This, in turn, minimizes the potential for blow-by of gases, including contaminants passing into the container when a vacuum is applied to the interior, and entrained powder material blowing out of the container when e.g. nitrogen is introduced.

After processing, the probes may be retracted through the head assembly 50 to the raised position to permit removal of the container. The container may be vibrated if desired to help settle the contents, which might be expanded somewhat due to the gas flows introduced during processing. To permit vibratory movement of the container, the lifting plate may be retracted to an intermediate position wherein the head assembly is retained in biased but less rigid contact with the container as previously described.

After equalization of the pressure within the container to the chamber pressure, the container may be disengaged fully from the head assembly. Similarly, after substantial equalization of the chamber pressure to the ambient atmospheric pressure, the enclosure 13 may be removed to provide access to the interior of the chamber 10. If desired a residual flow of oxygen-free gas, such as nitrogen, may be maintained in a gentle stream through the head assembly, or other structures not illustrated, so that the container may be removed from the processing location and conveyed to a suitable closing device of known design to prevent oxygen contamination during its transportation.

It should be understood that the present invention may be embodied in other specified forms without departing from its spirit or essential characteristics. The present embodiments are, therefore, to be considered in all respects as illustrative and not restrictive. All changes which come within the meaning and range of the equivalents of the claims are, therefore, intended to be embraced therein.

We claim:

1. A method for providing a selected environment to the interior of a container, comprising the steps of:

providing a probe with both an interior plenum for conveying a selected environment and an outlet for the environment;

moving the probe through an opening in the container and into the contents of the container so that the outlet is moved toward a desired location within the interior of the container; and causing the probe to stop its movement toward its desired location if the probe comes into contact with an obstruction;

wherein the step of causing the probe to stop comprises the steps of providing a controlled force to move the probe through the contents of the container, and selecting the controlled force to be less than the force required to damage the obstruction.

2. The method of claim 1 wherein the step of causing the probe to stop further comprises the steps of providing a controlled bias to at least a portion of the probe to allow the probe to yield upon contacting an obstruction, and selecting the biasing force to be less than the force required to damage the obstruction.

3. The method of claim 1 comprising the further steps of:

providing a flushing head which is large enough to cover the opening in the container;

moving the flushing head and container relatively toward one another so that the flushing head engages the opening in the container;

stopping the movement of the probe toward its desired location if it comes into contact with an obstruction, while permitting the flushing head to engage the opening in the container as desired.

4. An apparatus for providing a selected environment to the interior of a container, comprising:

a probe having both an interior plenum for conducting the selected environment and an outlet for the environment;

means for reciprocating at least a portion of the probe relative to the interior of the container so that the probe penetrates at least a portion of the contents of the container to position the outlet at a selected location within the container;

means for controlling reciprocation of at least a portion of the probe so that the probe may stop reciprocating before reaching its selected location upon contacting an obstruction; and a head assembly for engaging an opening in the container;

wherein said means for controlling reciprocation further permits said probe to stop reciprocating before reaching its selected location without preventing said head assembly from engaging the opening in the container.

5. The apparatus of claim 1 wherein said means for controlling reciprocation comprises means for biasing at least a portion of said probe so that said probe may yield when contacting an obstruction.

6. The apparatus of claim 5 wherein said means for biasing limits the force exertable by the probe so that it may exert only a selected maximum force to the obstruction interfering with its desired reciprocation.

7. The apparatus of claim 1 further comprising means for stopping the movement of the probe away from the container when the probe reaches a selected adjustable position.

8. The apparatus of claim 1 wherein said probe includes an upper reciprocating section, said upper reciprocating section having an inlet in communication with said interior plenum for admitting said selected environment to said interior plenum; said apparatus further comprising:

a fluid supply manifold having an interior plenum in fluid communication with said inlet at least when said probe is positioned within said container at said selected location; and means for providing said selected environment to said fluid supply manifold.

9. The apparatus of claim 8 wherein said fluid supply manifold comprises a fluid-tight body surrounding said upper reciprocating section of said probe and isolating said inlet from communication with non-selected environments.

10. The apparatus of claim 1 further comprising a fluid cylinder including a hollow reciprocating central tube, a fluid driven piston attached to said tube, and an outer enclosure;

said piston being drivingly attached to said tube and in sealing engagement with said outer enclosure to define at least one fluid pressure drive chamber;

said probe comprising said tube.

11. The apparatus of claim 10 wherein said means for reciprocating comprises said fluid pressure driven piston, and wherein said means for biasing comprises said piston in conjunction with said fluid pressure.

12. The apparatus of claim 11 wherein said fluid comprises an inert gas.

13. The apparatus of claim 5 wherein said means for reciprocating comprises a fluid pressure driven piston, and wherein said means for biasing comprises said piston in conjunction with said fluid pressure.

14. The apparatus of claim 13 wherein said fluid is an inert gas.

15. An apparatus for providing a selected environment to the interior of a container, comprising:

two or more probes having both interior plenums for conducting the selected environment and outlets for the environment;

motive means for reciprocating the probes and the interior of the container relative to each other so that at least a portion of the probe penetrate at least a portion of the contents of the container to position at least one outlet in a selected location within the container; and at least a first portion of one of said probes being movable relative to at least a portion of a second of said probes in a direction parallel to the direction of reciprocation.

16. The apparatus of claim 15 further comprising means for stopping the relative reciprocation of said first portion of said first probe when said probe comes into contact with a solid object, without stopping reciprocation of at least a portion of said second probe.

17. The apparatus of claim 15 further comprising means for stopping the reciprocation of the probes away from the container when the probes reach a selected adjustable position.

18. The apparatus of claim 14 wherein said container may contain a solid object with an obstructive surface, and wherein at least two of said probes are spaced apart a distance at least equal to the maximum linear dimension of the obstructive surface of the solid object.

19. The apparatus of claim 14 wherein said means for stopping comprises means associated with at least one probe for biasing at least a portion of the probe to allow it to yield if obstructed.

20. An apparatus for providing a selected environment inside a container, comprising:

a flushing head which is large enough to cover an open end of the container;

means for moving the flushing head and the container relatively toward and away from each other so that the flushing head selectively engages and covers the open end of the container;

first and second openings passing through the flushing head;

first and second probes passing through the flushing head via the first and second openings in the flushing head, each probe including both a plenum for conveying a selected environment and an outlet for said environment; and motive means for moving at least a portion of said probes through the first and second openings in the flushing head such that at least a portion of said probes penetrates selectively into the interior of the container.

21. The apparatus of claim 20 wherein said container may contain a solid object with an obstructive surface, and wherein the first and second openings in the flushing head are spaced apart a distance at least equal to the maximum linear dimension of the obstructive surface of the solid object.

22. The apparatus of claim 20 wherein the means for moving at least a portion of said probes comprises first and second pistons for driving the first and second probes, respectively.

23. The apparatus of claim 20 wherein the flushing head further includes a gasket on the lower surface for engaging the container opening.

24. The apparatus of claim 20 further comprising means for biasing at least a portion of at least one probe so that said probe may exert only a controlled maximum force to the contents of the container.

25. The apparatus of claim 20 further comprising means for stopping said penetration of at least a portion of at least one probe into the interior of the container when said probe is obstructed.

26. The apparatus of claim 20 further comprising means for stopping said penetration of at least a portion of at least one probe into the interior of the container when said probe is obstructed, without stopping said penetration by at least a portion of said second probe.

27. The apparatus of claim 26 wherein said means for stopping comprises means for biasing at least a portion of the probe to allow it to yield if obstructed.

28. The apparatus of claim 20 wherein said motive means includes means for moving the probes away from the container, said apparatus further comprising means for stopping the movement of the probes away from the container when the probes reach a selected adjustable position.

29. An apparatus for providing a selected environment to the interior of a container, comprising:

a probe having both an interior plenum for conducting the selected environment and an outlet for the environment;

means for reciprocating at least a portion of the probe relative to the interior of the container so that at least a portion of the probe penetrates at least a portion of the contents of the container to position the outlet in a desired location within the container;

means for biasing at least a portion of the probe so that it may exert only a selected maximum force; and a head assembly for engaging an opening in the container;

wherein said biasing means further permits said probe to stop reciprocating before reaching its selected location without preventing said head assembly from engaging the opening in the container.

30. An apparatus for providing a selected environment to the interior of a container, comprising:

two or more probes having both interior plenums for conducting the selected environment and outlets for the environment;

motive means for reciprocating the probes and the interior of the container relative to each other so that at least a portion of the probes penetrate at least a portion of the contents of the container to position at least one outlet in a selected location within the container; and means for biasing at least a portion of at least one probe so that said probe may exert only a controlled maximum force to the contents of the container.

31. A method for providing a selected environment to the interior of a container which may include a solid object with an obstructive surface positioned therein, comprising the steps of:

providing first and second probes with both an interior plenum for conveying a selected environment and an outlet for the environment;

spacing the probes apart from each other by a distance at least equal to the maximum linear dimension of the obstructive surface;

moving the probes into the contents of the container so that the outlets are moved toward desired locations within the container;

stopping the movement of a probe into the container if it comes into contact with the obstructive surface, while permitting the other probe to continue moving into the container to its desired location; and supplying the selected environment through the interior plenum and outlet of at least one of the probes.

32. The method of claim 31 further comprising the steps of:

providing a flushing head having at least first and second openings therein, which is large enough to cover an open end of the container;

moving the flushing head and container relatively toward one another so that the flushing head engages the open end of the container;

moving the first and second probes into the container through the first and second openings in the flushing head, respectively;

stopping the movement of a probe if it comes into contact with the obstructive surface, while permitting the flushing head to engage the opening in the container as desired.

33. The method of claim 32 further comprising the step of applying a vacuum to a third opening in the flushing head.

34. The method of claim 31 wherein the probes are moved into the container using a force which is less than the force required to damage the obstructing object if a probe comes into contact with the obstructive surface.

* * * * *

UNITED STATES PATENT AND TRADEMARK OFFICE

CERTIFICATE OF CORRECTION

PATENT NO. : 5,228,269
DATED : July 20, 1993
INVENTOR(S) : John E. Sanfilippo et al.

It is certified that error appears in the above-indentified patent and that said Letters Patent is hereby corrected as shown below:

IN THE CLAIMS

Col. 14, claim 5, line 54, delete "1" and substitute therefor --4--.

Col. 14, claim 7, line 62, delete "1" and substitute therefor --4--.

Col. 14, claim 8, line 66, delete "1" and substitute therefor --4--.

Col. 15, claim 10, line 15, delete "1" and substitute therefor --4--.

Col. 15, claim 15, line 43, delete "probe" and substitute therefor --probes--.

Col. 15, claim 19, line 65, delete "14" and substitute therefor --16--.

Signed and Sealed this

Fourteenth Day of June, 1994

Bruce Lehman

*Attest:*

BRUCE LEHMAN

*Attesting Officer*

*Commissioner of Patents and Trademarks*